United States Patent [1^1]

Bunish

[11] 4,313,029

[45] Jan. 26, 1982

[54] SHIELDED MINING CABLE

[75] Inventor: Stephen Bunish, Marion, Ind.

[73] Assignee: The Anaconda Company, Greenwich, Conn.

[21] Appl. No.: 80,309

[22] Filed: Oct. 1, 1979

[51] Int. Cl.[3] ..... H01B 7/08

[52] U.S. Cl. ..... 174/115; 174/106 SC; 174/117 F; 174/120 SC

[58] Field of Search ..... 174/117 F, 115, 120 SC, 174/102 SC, 105 SC, 106 SC

[56] References Cited

U.S. PATENT DOCUMENTS

| | | | |
|---|---|---|---|
| 2,558,929 | 7/1951 | Bunish | 174/120 SC |
| 2,689,268 | 9/1954 | Peck | 174/115 |
| 2,981,788 | 4/1961 | Bunish | 174/115 |
| 3,621,118 | 11/1971 | Bunish | 174/115 |
| 3,660,592 | 5/1972 | Anderson | 174/115 X |
| 3,707,595 | 12/1972 | Plate | 174/115 |
| 3,792,192 | 2/1974 | Platte | 174/120 SC |
| 4,002,820 | 1/1977 | Paniri | 174/115 |
| 4,008,367 | 2/1977 | Sundorhauf | 174/120 SC |

FOREIGN PATENT DOCUMENTS

| | | | |
|---|---|---|---|
| 225043 | 3/1958 | Australia | 174/115 |

*Primary Examiner*—Richard R. Kucia
*Attorney, Agent, or Firm*—Pennie & Edmonds

[57] ABSTRACT

A high-voltage electrical power cable comprises a substantially flat core (10) having a plurality of flexible power conductors (11), and insulating body (14) surrounding each power conductor, a ground wire (12), an insulated ground check wire (13); an outer jacket (20) surrounding the core; and a layer of semi-conducting material (30, 30*a*, 30*b*, and 30*c*) extruded about and in contact with the core. The ground wire is covered with a semi-conductive material in contact with the extruded layer to provide a current path to ground.

4 Claims, 4 Drawing Figures

SHIELDED MINING CABLE

DESCRIPTION

1. Technical Field

The present invention relates to a power cable commonly employed with mining equipment including an inner core comprising both the power and ground conductors, an outer jacket and a shielding system formed by an extruded layer of semi-conducting material therebetween.

2. Background Art

Various approaches in shielding cables have been employed in the prior art. U.S. Pat. No. 2,981,788 to Bunish, for example, discloses a cable including a plurality of power conductors surrounded first by an elastomeric polymeric insulation and then by a thin, separate anti-corona layer of semi-conducting material. The purpose of the semi-conductive layers is to minimize brush discharge or corona effects. By grounding the anti-corona layer, a charging current will leak off without impairing the insulating quality of the cable.

In industrial applications, the anti-corona layer typically comprises a tape of semi-conducting material which is overlapped about a power conductor. A flexible copper/cotton shield is then applied over the tape. Cable of this type has been marketed by the assignee of the present invention under the registered trademark "Securityflex" Type SHD-GC, illustrated by Data Section 7 551, the Anaconda Company, Greenwich, Conn. 06830.

As may be apparent, the above construction of cable requires that each power conductor be individually wrapped by the semi-conductive tape. A separate process step is required, but more importantly, the use of a tape in wrapping a power conductor gives rise to problems of tape separation and the possible separation of conductive particles from the tape upon handling of cable in use. The result is an impairment in the insulating quality of the cable, and the separation of conductive particulate affects the resistance of the semi-conductive tape.

DISCLOSURE OF INVENTION

The present invention in low-voltage electrical power cable seeks to improve upon the prior art described above with regard not only to the overall processing steps and size of cable per unit strength, but, importantly, by the combination of an extruded shielding layer to increase the safety factor of such cables. This is particularly important when the working environment for cables, of the type considered herein, is extremely rigorous. Physical damage may occur due to abrasion, excessive tension, and the crushing compression of fallen rock or heavy machinery when used in a mining operation. By extruding a semi-conductive layer about a core, an additional grounding capability is provided. Furthermore, by extrusion of such a layer the need that each individual conductor be surrounded by a tape layer, as in the prior art, is overcome, and the extrusion provides a significant economic advantage and an operative safety advantage as well.

In accordance with the invention, the cable includes a core of a flattened substantially elliptical shape having a plurality of power conductors insulated from one another and from both a ground wire and an insulated check wire; an outer jacket which surrounds the core; and an extruded shielding layer of semi-conductive material underlying the outer jacket and disposed about the core. As a further aspect of the invention, the ground wire which is in contact with the extruded shielding layer along their coextensive lengths is embedded in a semi-conductive material, thereby to provide a path to ground in the event of cable damage or in the event of penetration through the cable by tools or other instruments to the energized conductors.

Additional advantages and objects of the present invention will become apparent as the description, to be considered with reference to the accompanying drawing, continues.

BEST MODE FOR CARRYING OUT THE INVENTION

Figure 1:
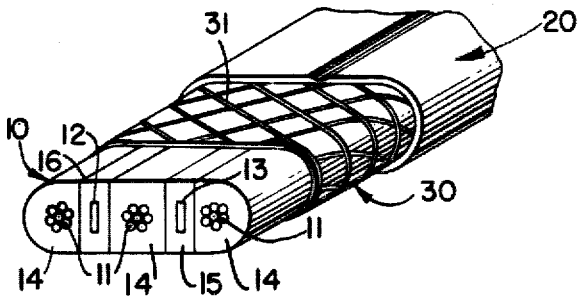
FIG. 1 is a layered perspective view of one form of the power cable of the present invention.

In each of the Figures, there is illustrated a power cable having a core 10, an outer jacket 20 and an extruded layer of semi-conductive material underlying the outer jacket and disposed about the core.

In each form of cable, the core includes a plurality of power conductors 11, a ground wire 12 and a ground check wire 13. Each of the conductors preferably includes bunched wires in a rope-lay-stranded configuration. The ground wire and ground check wire similarly include bunched wires in a rope-lay-stranded and shaped configuration, although only schematically represented. As illustrated, the core 10 is of a flattened substantially eliptical shape and the conductors and wires are disposed along its major axis. Each of the conductors is located in an insulative body 14, with each body being spaced apart by a body within which one of the ground check wire and ground wire is disposed. The insulative body supporting each of the conductors may be formed of an elastomeric material such as neoprene or a cross-linked polyethylene/ethlene-propylene (XLP/EP) blend. The XLP/EP blend is preferred. The ground check wire is disposed in an insulative body 15 of a polymeric material, such as a yellow polypropylene, marketed by Hercules under the tradename identification SE-012.

This construction of core generally follows that described by the assignee of the present invention in the publication or trade material identified as "Data Section 7 133", directed to a portable cable, identified by the registered trademark "Securityflex" as Type G-GC. The cable described in the publication or trade material includes a core and an outer jacket which, as the outer jacket 20 of the present cable, is formed of a heavy duty insulative material, such as a lead-cured neoprene or chloro-sulfonated polyethylene (CSP) elastomeric polymer, such as that sold under the tradename Hypalon by the du Pont Company. These materials are well known and in the preferred embodiment, the jacket 20 is formed of Hypalon. The jacket, further, may be formed either as a single or double extruded layer, the layers being separated by a web (not shown) of rayon or nylon, for example. Hypalon has been found to provide satisfactory resistance to abrasion, compression and wear, among other considerations which are paramount in the utilization of the cable in mining environments, and this material is preferred.

The core of the present invention, however, differs from the construction of core described in the publication or trade material discussed immediately above. To this end, the ground wire 12 of the core is surrounded by a covering or bedding jacket 16. The jacket which may be extruded or otherwise disposed above the ground wire may be formed of an ethylenepropylene (EP) blend material, Hypalon or other thermosetting polymeric material, such as polypropylene including conductive medium, such as carbon black or the equivalent interspersed uniformly therein in an amount of about 20–30 percent by weight. The covering 16, thus, is semiconductive and together with the extruded layer of semi-conducting material to be described in more particular fashion functions to reduce hazard of shock, and consequent danger to life and property by providing a circuit path from the power conductors to ground in the event of damage to the cable, or penetration of the cable by tools, and so forth. The cable overall is of a flattened, substantially elliptical shape and offers maximum resistance to damage as a result of a crushing force imparted by mining equipment, for example.

Referring to FIG. 1, the layer of semi-conducting material provides a shielding layer 30. The shielding layer of the form of the invention of FIG. 1, as well as the other forms of the invention to be described, may be formed of EP blend material including an interspersed conductive medium as previously discussed. Further, the shielding layer may be extruded directly over or otherwise formed about the core 10. Preferably, the shielding layer is extruded directly over the core. A web 31 of nylon or other reinforcing material as may be commonly used in the industry is wrapped helically about the shielding layer.

Figure 2:
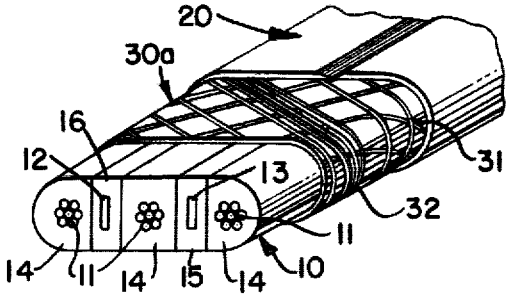
FIG. 2 is a view similar to FIG. 1 of yet a further form of power cable.

FIG. 2 illustrates a further form of shielding layer 30*a*. This shielding layer similarly carries a web 31, similar to that of FIG. 1 and a carrier 32 of shield wires. The carrier is both wrapped about and in contact along the shielding layer.

Figure 3:
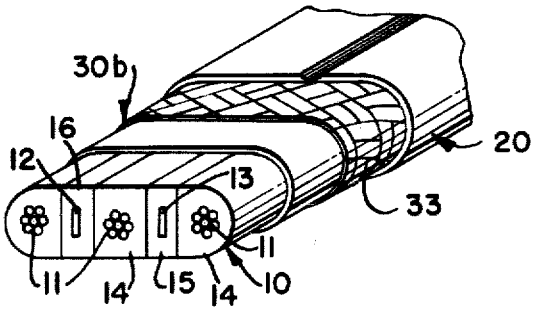
FIG. 3 is a view similar to FIG. 1 of yet a further form of power cable.

FIG. 3 illustrates a further form of shielding layer 30*b*. In this form of the invention, a cotton/copper braided shield 33 is both wrapped about and in contact along the shielding layer.

Figure 4:
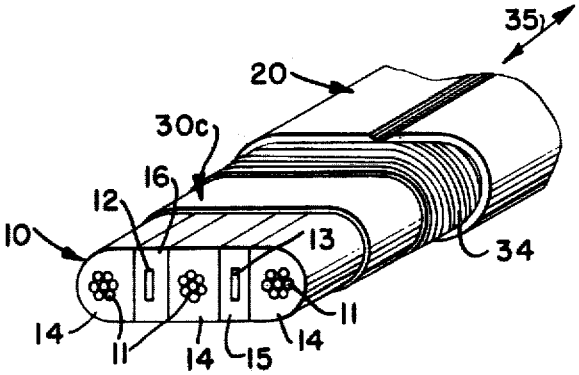
FIG. 4 is a view similar to FIG. 1 of another form of power cable.

FIG. 4 illustrates another form of shielding layer 30*c*. In this form of the invention a wire serve 34 is both wrapped about and in contact along the shielding layer. The lay of the wire serve preferably is perpendicular to the longitudinal axis of the core 10, illustrated by the directional line 35.

By way of illustration, not in a limiting sense, the following will describe several workable forms of the invention:

| CABLE | FIG. 1 | FIG. 2 | FIG. 3 | FIG. 4 |
|---|---|---|---|---|
| Core | | | | |
| conductor | #6 3/C | same | same | same |
| check | #8 | same | same | same |
| (insulated as set out in description) | | | | |

-continued

| CABLE | FIG. 1 | FIG. 2 | FIG. 3 | FIG. 4 |
|---|---|---|---|---|
| ground | #8 | same | same | same |
| (flat covered with 20 mils, semi-conductive material, major OP height of insulated conductor) | | | | |
| Shielding Layer (semi-conductive material) | | | | |
| Thickness | 75 Mils | 45 Mils | 30 Mils | 45 Mils |
| Outer Jacket (Hypalon) | | | | |
| Thickness | 80 Mils | 110 Mils | 125 Mils | 110 Mils |

Having described the invention with particular reference to the preferred forms thereof, it will be obvious to those skilled in the art to which the invention pertains after understanding the invention, that various changes and modifications may be made therein without departing from the spirit and scope of the invention as defined by the claims appended hereto.

I claim:

1. An electrical power cable comprising (a) a core of flattened, substantially elliptical shape having a major axis and a minor axis normal thereto including (1) a plurality of three power conductors, (2) a ground check conductor, (3) a ground conductor, and (4) plural bodies of elastomeric material and each said conductor disposed in a separate body wherein (i) said bodies supporting each said power conductor and ground check conductor is an insulating material, (ii) said body supporting said ground conductor comprising a bedding jacket of semi-conductive material forming part of a current path to ground, (iii) each said body of elastomeric material arranged along said major axis, and (iv) one of said ground conductor and ground check conductor located between a first pair of power conductor and the other of said ground conductor and ground check conductor located between the other pair of power conductor bodies;

(b) a jacket surrounding said core, said jacket being formed of an insulative material; and (c) a continuous layer of a semi-conducting material substantially of equal thickness throughout disposed around and in contact with said core thereby to provide an additional part of said current path to ground in the event of the occurrence of physical damage to said electrical power cable.

2. The electrical power cable recited in claim 1 including at least a web of reinforcing material comprised of at least one carrier of wire disposed helically around and in contact with said layer.

3. The electrical power cable recited in claim 1 including a shield formed of a cotton/copper braid, said shield being disposed about and in contact with said layer.

4. The electrical power cable recited in claim 1 including a wire serve, said wire serve being wrapped about and in contact with said layer in a manner that the lay of said wire serve is substantially perpendicular to the axis of said core which is, in turn, perpendicular to said major and minor axes.

* * * * *